United States Patent [19]

Schwartz et al.

[11] 4,376,649

[45] Mar. 15, 1983

[54] CONTINUOUS PROCESS OF SMELTING METALLIC LEAD DIRECTLY FROM LEAD-AND SULFUR-CONTAINING MATERIALS

[75] Inventors: Werner Schwartz, Buchholz; Peter Fischer, Bad Vilbel, both of Fed. Rep. of Germany

[73] Assignee: Metallgesellschaft Aktiengesellschaft, Frankfurt am Main, Fed. Rep. of Germany

[21] Appl. No.: 275,560

[22] Filed: Jun. 19, 1981

[30] Foreign Application Priority Data

Aug. 6, 1980 [DE] Fed. Rep. of Germany ..... 3029682

[51] Int. Cl.[3] ..... C22B 13/06

[52] U.S. Cl. ..... 75/78; 75/24; 75/77; 75/70

[58] Field of Search ..... 75/23, 78, 77, 70, 63, 75/79, 93 DA, 24

[56] References Cited

U.S. PATENT DOCUMENTS

| | | | |
|---|---|---|---|
| 1,809,871 | 6/1931 | Smith | 75/70 |
| 3,663,207 | 5/1972 | Themelis et al. | 75/77 |
| 3,941,587 | 3/1976 | Queneau et al. | 75/72 |
| 4,294,433 | 10/1981 | Vanjukou et al. | 266/161 |

OTHER PUBLICATIONS

Davey, T. R. A. "Debismuthizing of Lead", Transactions AIME vol. 206, 1956 and Journal of Metals, Mar. 1956, pp.341–350.

*Primary Examiner*—L. Dewayne Rutledge
*Assistant Examiner*—Christopher W. Brody
*Attorney, Agent, or Firm*—Sprung, Horn, Kramer & Woods

[57] ABSTRACT

A molten bath consisting of a slag phase is maintained in an elongated horizontal reactor. The charge is fed into the reactor on one side thereof onto the molten bath in a melting zone so as to maintain an oxidation potential which causes metallic lead and slag to be formed. Reducing agent is introduced into the slag phase on the other side of the reactor in a reducing zone. To ensure that the bismuth contained in the charge is collected in the smallest possible quantity of crude lead, such an oxidation potential is maintained in the molten bath in the melting zone that the lead phase contains 0.05 to 2% by weight sulfur, the high-Bi primary lead which becomes available in that zone is separately tapped, and the low-Bi secondary lead which becomes available in the reducing zone is also separately tapped.

6 Claims, 2 Drawing Figures

CONTINUOUS PROCESS OF SMELTING METALLIC LEAD DIRECTLY FROM LEAD-AND SULFUR-CONTAINING MATERIALS

BACKGROUND OF THE INVENTION

1. Field of the Invention

This invention relates to a continuous process of smelting metallic lead directly from lead-and sulfur-containing materials in an elongated horizontal reactor, wherein a molten bath consisting of a slag phase and a lead phase is maintained in the reactor the charge is fed into the reactor on one side thereof onto the molten bath in a melting zone so as to maintain an oxidation potential which causes metallic lead and slag to be formed, reducing agents are introduced into the slag phase on the other side of the reactor in a reducing zone, and low-lead slag and metallic lead are tapped from their respective phases.

2. Discussion of Prior Art

German Offenlegungsschrift No. 28 07 964 discloses such a continuous process of converting lead sulfide concentrates into a liquid lead phase and a slag phase under a gas atmosphere having $SO_2$—containing zones in an elongated horizontal reactor. In that known process, lead sulfide concentrates and fluxes are charged onto a molten bath. The lead phase and a slag phase having a low non-ferrous metal content are discharged at mutually opposite ends of the reactor, and the phases flow countercurrently to each other in substantially continuous layer-forming streams to the outlet ends. At least part of the oxygen is blown into the molten bath from below through a plurality of mutually independently controlled nozzles, which are distributed over the length of the oxidizing zone of the reactor. The solid charge is charged into the reactor in several stages through a plurality of mutually independently controlled feeders, which are distributed over a substantial length of the reactor.

The locations and rates at which oxygen and solids are fed are so selected that the gradient of the oxygen activity in the molten bath has at the lead discharge end a maximum for the production of lead and from said maximum decreases progressively to a minimum for the production of slag phase having a low non-ferrous metal content, which minimum is obtained at the end where said slag phase is discharged. Gaseous and/or liquid protective fluids are blown into the molten bath at controlled rates together with the oxygen and serve to protect the nozzles and the surrounding lining and to assist the control of the process temperature. The rates at which gases are blown into the molten bath are so controlled that the resulting turbulence is suffficient for a good mass transfer but will not substantially disturb the flow of the phases in layers and the gradient of the oxygen activity. The gas atmosphere in the reactor is conducted countercurrently to the direction of flow of the slag phase. The exhaust gas is withdrawn from the reactor at the outlet end for the phase having a high non-ferrous metal content.

German No. 24 17 978 discloses such a process in which the gas atmosphere is conducted cocurrently to the slag phase.

U.S. Pat. No. 3,663,207 discloses a direct lead-smelting process in which the slag phase and lead phase are cocurrently conducted through the reactor, the slag is tapped at one end of the reactor and the lead is tapped from an intermediate zone of the reactor.

"Engineering Mining Journal," April, 1978, pages 88 to 91, describes on page 118 a direct lead-smelting process in which the fine-grained concentrate is ignited in a vertical shaft in the presence of oxygen and in fluidized state is roasted, smelted and partly reduced to metallic lead. From a hearth furnace under the shaft, the molten material flows under a partition into a hearth chamber, which is subjected to electric resistance heating and in which non-ferrous metal oxides are reduced to liquid lead. Slag and lead are tapped from that hearth chamber.

In these known direct lead-smelting processes, the crude lead which is tapped contains the entire bismuth. Bismuth is an impurity, which must be removed from the final product (refined lead) at high cost, and is also a by-product, which has a commercial value. A large part of the refined lead which is produced can be sold with Bi contents of 100 ppm and more. In certain grades, however, 70 ppm Bi or even less must not be exceeded. Where high-Bi lead concentrates are used, the refining costs involved in the removal of bismuth are usually more than offset by the commercial value of that metal but with raw materials having a low Bi content the refining costs exceed the proceeds. For this reason, numberous lead smelters separate their high-Bi and low-Bi raw materials and process them in separate batch operations. That practice results in numerous difficulties in the smelting and refining operations and also in a loss of interest on capital, particularly when concentrates high in noble metals must be stored for a long time.

It is also known to extract metallic lead from lead sulfide ores by the roast-re-acting process stages. In the first stage, part of the lead content is extracted as primary metallic lead and a high Pb slag is formed. The high-Pb slag is tapped and charged to the second stage, in which the secondary metallic lead is extracted and a low-Pb slag is formed under reducing conditions. The primary lead recovered in the first stage includes a major part of the bismuth contained in the charge. As a result, the secondary lead is low in Bi (German No. 589,738; German No. 590,505; German Offenlegungsschrift No. 27 39 963). These processes are not suitable for the continuous processes of the kind described first hereinbefore, in which lead is directly smelted in a single stage.

It is an object of the invention to provide a continuous process of directly smelting lead in a single stage in which the bismuth content of the charge is collected in the smallest possible quantity of crude lead.

SUMMARY OF THE INVENTION

This invention is accomplished in accordance with the invention in that an oxidation potential is maintained in the molten bath in the melting zone that the lead phase contains 0.05 to 2% by weight sulfur, the high-Bi primary lead which becomes available in that zone is separately tapped, and the low-Bi secondary lead which becomes available in the reducing zone is also separately tapped. The materials which contain lead and sulfur may consist of lead sulfide materials, lead sulfate materials, and lead oxide materials which contain sulfide of sulfates. Preferable the oxidation potential in the molten bath of the melting zone is such that the lead phase contains 0.1 to 2.0 percent by weight of sulfur.

If the material is fed in a solid state onto the molten bath, the melting zone is located in the molten bath itself. In that case, oxygen is introduced into the molten bath to maintain an oxidation potential which is sufficient for the formation of metallic lead and slag and for obtaining the required sulfur content in the lead phase. If the material reacts and is molten in a fluidized state in a melting zone over the molten bath disposed at the bottom of the reactor, such an oxidation potential is maintained in the fluidizing zone that the lead phase has the required sulfur content when it has settled into the molten bath. If the solids are melted partly in a fluidized state and partly in the molten bath, the oxidation potentials are properly matched.

The oxidation potential is related to the stoichiometric ratio of oxidizing agents, such as oxygen, metal sulfates, metal oxides, to oxidizable constituents, such as sulfide sulfur, and any added fuel. The total quantity of said oxidizable constituents is so controlled that a partial oxidation is effected, with which the required sulfur content in the lead phase is obtained. Generally speaking, the phase is conducted such that the primary lead tapped from the oxidation zone contains at least 80% of the bismuth in the charge in about 10 to 20% by weight of the lead in the charge. This permits recovery of a separately tapped secondary lead of lower bismuth quantity, e.g., no more than 20% of the original quantity of bismuth in the charge in at least about 80% by weight of the lead in the charge. The secondary lead is removed from a portion of the reactor where reducing conditions prevail.

The rate at which primary lead is withdrawn is minimized but should be so large that a major part of the bismuth contained in the charge is included in the primary lead. The rate of Bi-enrichment in the primary lead depends on the analysis of the ore. The primary lead has only low contents of tin, arsenic and antimony. A major part of the Sn, As and Sb contained in the charge is included in the secondary lead.

In accordance with a pre-ferred feature, in the processing of materials containing more than 55% by weight lead, a sulfur content of 0.1 to 0.4% by weight is maintained in the lead phase in the melting zone. In the processing of high-lead materials, this measure ensures a good collection of the bismuth in a relatively small quantity of primary lead.

In accordance with a further preferred feature, in the processing or materials containing 40 to 55% by weight lead, a sulfur content of 0.3 to 1.0% by weight is maintained in the lead phase in the melting zone. In the processing of low-lead materials, this measure ensures a good collection of bismuth in a relatively small quantity of primary lead.

In accordance with a further preferred feature, in the processing of materials containing less than 40% by weight lead, a sulfur content of 0.8 to 2.0% by weight is maintained in the lead phase in the melting zone. This measure results even in the processing of very low-lead materials in a good collection of bismuth in a relatively small quantity of primary lead.

In accordance with a further preferred feature, the slag phase and lead phase are countercurrently conducted through the reactor, the primary lead is tapped at that end of the reactor which defines the melting zone, and the secondary lead is tapped behind a weir, which is provided on the bottom of the reactor at the other end of the melting zone and protrudes into the slag zone. The methods and apparatuses of German Offenlegungsschrift No. 28 07 964 and German No. 24 17 978, the disclosure of which is specifically incorporated herein by reference, which disclosures have been discussed hereinbefore, can be used in carrying out the process according to the invention. It is particularly suitable if a weir is provided which permits a separate tapping of the primary and secondary leads. In that case the bottom of the reactor may have such an inclination that the primary and secondary leads flow toward the melting zone. The secondary lead is then tapped at the weir. Alternately, the bottom of the reactor may have such an inclination that only the primary lead flows to the melting zone end and the secondary lead flows to the other end and is tapped there.

According to a further preferred feature, a narrow zone is provided, which precedes the tap for the primary lead and into which no charge is fed and in which sulfur is removed from the lead by oxidation. A particularly exact adjustment of the sulfur content of the lead phase can be effected in that zone so that a large quantity of the bismuth can be collected and a particularly small relative quantity of tapped primary lead will be permitted.

BRIEF DESCRIPTION OF DRAWINGS

The invention will be explained more fully with reference to the drawings.

DESCRIPTION OF SPECIFIC EMBODIMENT

Figure 1:
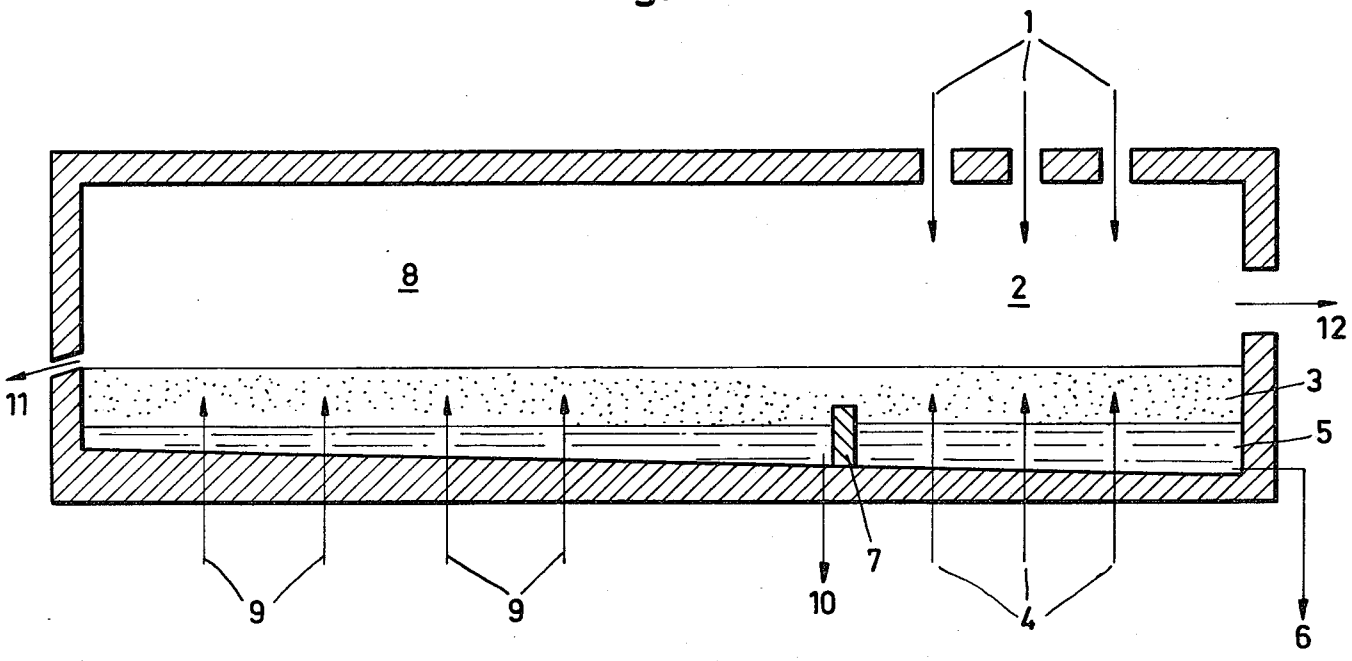
FIG. 1 is a diagrammatic longitudinal sectional view showing a reactor in which the slag and lead phases are countercurrently conducted and the secondary lead is tapped before a weir.
Figure 2:
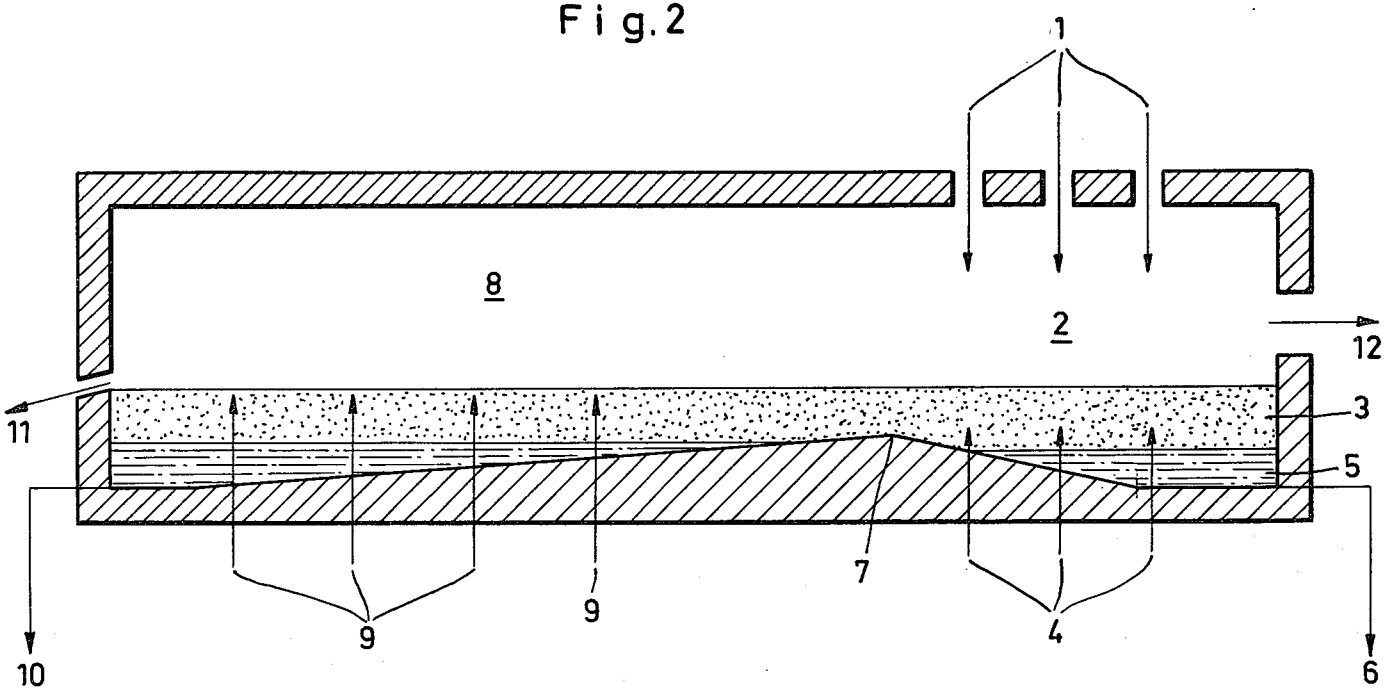
FIG. 2 is a diagrammatic longitudinal sectional view showing an arrangement in which the secondary lead is tapped at the end wall of the reducing zone.

In a melting zone 2, a charge 1 is fed into a slag phase 3. Oxygen 4 is introduced from below into a lead phase 5 and flows from the latter through the slag phase 3. Primary lead is tapped from the melting zone at the end wall 6. The slag flows over the weir 7 into a reducing zone 8, into which pulverized coal as reducing agent 9 is blown from below. Low-lead slag is tapped through the slag tap 11. Exhaust gas 12 is withdrawn through the end wall defining the melting zone 2. In accordance with FIG. 1, secondary lead 10 is tapped before the weir 7 in accordance with FIG. 1 and at the end defining the reducing zone 8 in accordance with FIG. 2.

EXAMPLES

Lead concentrates which had been pelletized in a mixture with fine dust and fluxes were smelted in a refractory-lined reactor, which was rotatably mounted and constituted a horizontal cylinder having an inside length of 4.5 m and an inside diameter of 1.20 m. The reactor was provided at its front end with a burner and with tap holes and at its rear end with an exhaust gas opening, in the upper portion of its shell with feed openings and in the lower portion of the shell with vertically upwardly directed nozzles.

The pellets had the following composition:

| | |
|---|---|
| 67.9 | % Pb |
| 12.3 | % S |
| 0.12 | % Sn |
| 0.038 | % Bi |
| 0.007 | % Sb |
| 0.05 | % As |

-continued

| | |
|---|---|
| 4.7 | % FeO |
| 1.3 | % CaO |
| 0.3 | % Mg0 |
| 3.5 | % SiO |
| 6.8 | % moisture |

To melt the pellets, the reactor was heated by means of the burner to a temperaure of 950° C., commercial-grade oxygen was fed through the nozzles at a rate of 150 $m^3/h$ (NTP), and pellets were charged into the reactor at a rate varied between 1.9 and 2.1 metric tons per hours.

1. In a first experiment the burner was not operated and pellets at a rate of exactly 2.1 metric tons per hour were charged into the reactor, in which a temperature of 950° C. was obtained. Under these conditions, the partial oxidation of the lead sulfide resulted in metallic lead which contained 0.42% S and was formed at a rate of 44% of the rate at which lead was supplied in the pellets. The metals Sn, Bi, Sb and As were distributed as follows:

| Metal | Content in lead % | Proportion of charged quantity % |
|---|---|---|
| Sn | less than 0.01 | less than 3 |
| Bi | 0.11 | 96 |
| Sb | less than 0.001 | less than 5 |
| As | less than 0.01 | less than 7 |

It is seen that the lead which was formed contained 96% of the Bi which had been charged but only minor quantities of the three other metals.

The slag contained 40% of the lead contained in the charged pellets and contained the metals in question in the following concentrations:

| Metal | Content in Slag | Proportion of charged quantity |
|---|---|---|
| Pb Metal | Content in slag % | Proprotion of charged quantity % |
| Pb | 63.4 | 40.0 |
| Sn | 0.28 | 99.9 |
| Bi | 0.002 | 2.3 |
| Sb | 0.016 | 97.9 |
| As | 0.10 | 85.7 |

2. In a second experiment the burner was shut down, oxygen was supplied at a rate of 150 $m^3/h$ (NTP) and the pellet supply rate was reduced to 2.0 metric tons per hour. This resulted in a higher rate of oxidation of lead sulfide to lead oxide so that the temperature of the molten bath increased to 965° C. Lead was recovered at only 30% of the rate at which lead was charged in the pellets and contained only 0.27% S. The Metals Sn, Bi, Sb and As were distributed as follows:

| Metal | Content in lead % | Proportion of charged quantity % |
|---|---|---|
| Sn | Less than 0.01 | less than 2 |
| Bi | 0.17 | 93 |
| Sb | less than 0.001 | less than 3 |
| As | less than 0.01 | less than 5 |

It is seen that the increase of the oxidation potential to values corresponding to an S content of 0.27% in the lead did not appreciably change the distribution of the metal, with the exception of the Bi.

But the Bi was enriched in the lead phase to 1.5 times its content obtained in Example 1.

3. In a third experiment, the pellet supply rate was reduced again by 0.1 metric ton per hour to 1.9 metric tons per hour.

As a result, the temperature of the molten bath increased to 985° C. and the lead phase contained only 0.18% S. Metal was formed at a rate of 10% of the rate at which lead was supplied in the pellets.

The metals Sn, Bi, Sb and As were distributed as follows:

| Metal | Content in lead % | Proportion of charged quantity % |
|---|---|---|
| Sn | less than 0.01 | less than 1 |
| Bi | 0.47 | 85 |
| Sb | less than 0.001 | less than 1 |
| As | less than 0.01 | less than 2 |

It is seen that the increase of the oxidation potential of the molten bath to values corresponding to a content of 0.18% S in the lead again did not substantially change the distribution of the metals, with the exception of the Bi. Whereas the yield of Bi in the lead phase was lower by 11% than in Example 1, it was enriched to more than four times its previous content.

4. In a fourth experiment the slag which had been obtained in the first experiment and contained only 2.3% of the Bi which was charged in the pellets but a major portion of the As, Sb and Sn was subjected to a reducing treatment.

For this purpose the lead disposed as a bottom phase under the slag was selectively tapped through a tap hole disposed on the bottom level of the reactor whereas the slag was left in the reactor. The nozzles were then replaced by injectors for pulverized coal.

Thereafter the burner was operated to raise the slag temperature gradually to a final value of 1150° C. At the same time, a mixture of pulverized coal and an entraining gas was blown at a controlled rate into the slag bath.

In this way the simultaneous oxidation and reduction in different zones, which can be effected only in an elongated reactor, was simulated by a performance of these steps at different times in the same space.

The following molten products were obtained:

METALLIC LEAD, in which the metal considered were distributed as follows:

| Metal | Content in lead % | Proportion of charged quantity % |
|---|---|---|
| Sn | 0.37 | 77 |
| Bi | 0.003 | 2 |
| Sb | 0.02 | 71 |
| As | 0.13 | 64 |

Slag, which contained the following metals (in %)

| | |
|---|---|
| Pb | 0.9 |
| Sn | 0.20 |
| Bi | 0.002 |
| Sb | 0.011 |

-continued

| | |
|---|---|
| As | 0.01 |

It is seen that only a small part of the Bi contained in the pellets and a major part of the Sn, Sb and As were collected in the secondary lead phase.

5. In a fifth experiment a low-lead concentrate was pelletized with fine dust and fluxes to form pellets having the following composition:

| | |
|---|---|
| 29.7 | % Pb |
| 22.1 | % S |
| 0.016 | % Bi |
| 1.6 | % Zn |
| 20.9 | % FeO |
| 4.3 | % CaO |
| 16.7 | % $SiO_2$ |
| 8.4 | % moisture |

Metallic lead was formed by the partial oxidation of that material only when the oxidation potential corresponded to an S content of 1.6% in the lead phase.

91% of the Bi charged in the pellets were collected in the lead phase, which contained 0.26% Bi The slag formed in an equilibrium with that lead phase contained 23.9% Pb and 0.002% Bi.

The advantages afforded by the invention reside in that a single-stage direct lead-smelting process is provided in which a major part of the bismuth contained in the charge can be collected in a simple manner in a relatively small quantity of primary lead.

What is claimed is:

1. In a continuous process of smelting metallic lead directly from lead- and sulfur-containing materials, said lead- and sulfur-containing materials containing at least one metal of the group tin, arsenic, antimony and zinc, in an elongated horizontal reactor, which materials also contain bismuth, wherein a molten bath consisting of a slag phase containing at least one metal of the group of tin, arsenic, antimony and zinc and a lead phase is maintained in the reactor, the charge is fed into the reactor at one end thereof onto the molten bath in a melting zone so as to maintain an oxidation potential in an oxidation zone which causes formation of a metallic lead phase and a slag phase containing at least one metal of the group tin, arsenic, antimony and zinc, reducing agent is introduced into the slag phase at the other end of the reactor in a reducing zone, and low-lead slag and metallic lead are tapped from their respective phases, the improvement wherein an oxidation potential is maintained in the molten bath in the melting zone such that the lead phase contains 0.05 to 2% by weight sulfur, a high-Bi primary crude lead which becomes available in the melting zone is separately tapped, and the low-Bi secondary crude lead which becomes available in the reducing zone is also separately tapped.

2. A processing according to claim 1, wherein the charge contains more than 55% by weight lead and a sulfur content of 0.1 to 0.4% by weight is maintained in the lead phase in the melting zone.

3. A process according to claim 1, wherein the charge contains 40 to 55% by weight lead and a sulfur content of 0.3 to 1.0% by weight is maintained in the lead phase in the melting zone.

4. A process according to claim 1, wherein the charge contains less than 40% by weight lead and a sulfur content of 0.8 to 2.0% by weight is maintained in the lead phase in the melting zone.

5. A process according to claim 1, wherein the slag phase and lead phase are countercurrently conducted through the reactor, the primary lead is tapped at that end of the reactor which defines the melting zone, and the secondary lead is tapped behind a weir, which is provided on the bottom of the reactor at the other end of the melting zone and protrudes into the slag zone.

6. A process according to claim 1, wherein a confined zone is provided, which precedes the tap for the primary lead and into which no charge is fed and in which sulfur is removed from the lead by oxidation.

* * * * *